US007850379B2

(12) United States Patent
Knapton et al.

(10) Patent No.: US 7,850,379 B2
(45) Date of Patent: Dec. 14, 2010

(54) TWO-NIB CRAYON AND METHOD OF MANUFACTURE

(75) Inventors: Emily Knapton, Omaha, NE (US); Janice Z. Olsen, Bethesda, MD (US)

(73) Assignee: No Tears Learning Inc., Cabin John, MD (US)

( * ) Notice: Subject to any disclaimer, the term of this patent is extended or adjusted under 35 U.S.C. 154(b) by 0 days.

(21) Appl. No.: 11/742,601

(22) Filed: May 1, 2007

(65) Prior Publication Data

US 2008/0273912 A1 Nov. 6, 2008

(51) Int. Cl.
*B43K 27/04* (2006.01)

(52) U.S. Cl. ..... 401/34

(58) Field of Classification Search ..... 401/16, 401/19, 34, 35, 49, 88, 91, 96, 97
See application file for complete search history.

(56) References Cited

U.S. PATENT DOCUMENTS

| | | | | |
|---|---|---|---|---|
| 264,564 | A | 9/1882 | Reckendorfer | |
| 471,191 | A | 3/1892 | Prewitt | |
| 964,422 | A * | 7/1910 | Hood | 401/49 |
| 2,167,465 | A | 7/1939 | Sell | |
| 2,205,907 | A | 6/1940 | Oxley | |
| 2,785,654 | A | 3/1957 | Lundberg, Sr. et al. | |
| 2,870,740 | A | 1/1959 | Vogt | |
| D241,343 | S | 9/1976 | Harmon | |
| D307,602 | S | 5/1990 | Lee | |
| D316,272 | S | 4/1991 | Lee | |
| D319,261 | S | 8/1991 | Lee | |
| D504,910 | S | 5/2005 | Lee | |

FOREIGN PATENT DOCUMENTS

| | | | |
|---|---|---|---|
| JP | 57-202361 | | 12/1982 |
| JP | 2003-276391 | A * | 9/2003 |
| WO | 8200444 | A * | 2/1982 |

* cited by examiner

*Primary Examiner*—Huyen Le
(74) *Attorney, Agent, or Firm*—Hogan Lovells US LLP

(57) ABSTRACT

A two-nib crayon includes two crayon halves of different colors, each crayon half including a flat end and a nib end. The flat ends are fused together to form an integrated one-piece structure such that the respective nib ends are disposed in opposing relation. The two-nib crayon makes learning exercises using a color activity more fun.

3 Claims, 1 Drawing Sheet

TWO-NIB CRAYON AND METHOD OF MANUFACTURE

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

The present invention relates to a two-nib crayon and, more particularly, to a two-nib crayon with different colors at each nib.

In any teaching program, particularly for young children such as pre-Kindergarten children, it is beneficial to utilize teaching exercises that are fun. It is also desirable to utilize exercises that develop hand coordination and fine motor skills to assist students in learning how to recognize and create letters.

BRIEF SUMMARY OF THE INVENTION

A two-nib crayon as described herein serves as a complement to learning activities. The crayon includes opposing nibs at opposite ends, each of a different color. The crayon size promotes a proper grip, while the two-nib construction helps children develop hand coordination and fine motor skills as they flip the crayons to change colors.

In an exemplary embodiment of the invention, a crayon comprises two crayon halves of different colors, each crayon half including a flat end and a nib end. The flat ends are fused together to form an integrated one-piece structure, where the respective nib ends are thereby disposed in opposing relation. In one arrangement, the respective nib ends are of complementary colors. In a preferred embodiment, the integrated one-piece structure is less than 3 inches in length, or more preferably less than 2½ inches in length, and most preferably about 2⅜ inches in length.

In another exemplary embodiment of the invention, a method of manufacturing a two-nib crayon includes the steps of securing a first crayon half in a cylindrical mold, the first crayon half being of a first color; securing a second crayon half in the cylindrical mold and coaxial with the first crayon half, the second crayon half being of a second color, different from the first color; and heating facing ends of the first and second crayons halves and fusing the facing ends together. In this manner, an integrated one-piece crayon is formed. Each of the first and second crayon halves preferably includes a flat end and a nib end, wherein the steps of securing the first and second crayon halves are practiced by securing the first and second crayon halves in the cylindrical mold with the flat ends facing each other.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
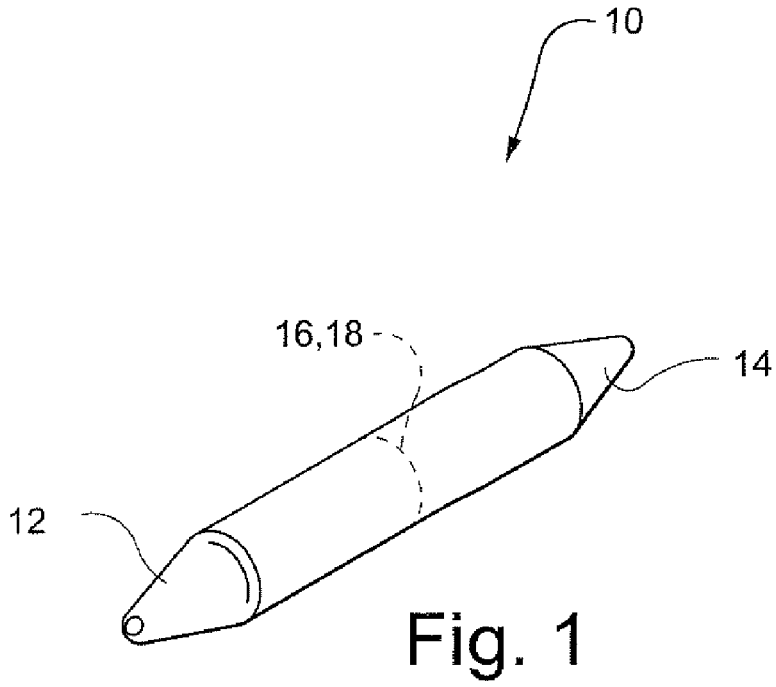
FIG. 1 is a perspective view of the two-nib crayon described herein.

FIG. 1 is a perspective view of a two-nib crayon 10. Preferably, the crayon 10 is formed of two crayon halves, each including a conical (tapered) nib end 12, 14 and a flat end 16, 18. The flat ends 16, 18 are fused together by heating or the like in a mold to form an integrated one-piece structure. Consequently, the respective nib ends 12, 14 are disposed in opposing relation (i.e., opposite ends of the crayon 10).

Although any color halves may be fused together, it is preferable to fuse complementary colors such as red/green, yellow/purple, and orange/blue.

With the crayon halves integrated into the one-piece structure, it is preferable that the one-piece structure be less than 3 inches in length, and more preferable that the integrated one-piece structure be less than 2½ inches in length. In a preferred exemplary embodiment, each crayon is manufactured to about 2⅜ inches in length. This size is selected to be particularly suited for smaller hands, which will serve to promote the proper grip of a writing utensil. In this context, the study of grasp development in children proves that children develop grasping patterns along a continuum. Typically, children at a young age (24 months) will grasp items in the 'palm' of their hand (they will use a 'fisted' grasping pattern). As children mature, so should grip. The most desired functional grip for handwriting is the dynamic tripod grip (holding a crayon or pencil with the thumb, index, and middle finger). Tools provided to a child at a young age will affect a child's natural grasping tendencies. Small tools (small crayons, toys, finger foods) will typically elicit the use of the finger tips, thus encouraging the development of a mature grip (i.e. the dynamic tripod grip). Tools that are large (beginning pencils and full-size or jumbo crayons) can elicit the use of earlier grasping patterns (i.e. a fisted grasp) and can delay the transition or development to more mature patterns.

The size of the crayon described herein is carefully designed to fit comfortably in a child's hand (in natural proportion) so to elicit the use of the finger tips and discourage the use of 'fisted' immature grasping patterns.

Figure 2:
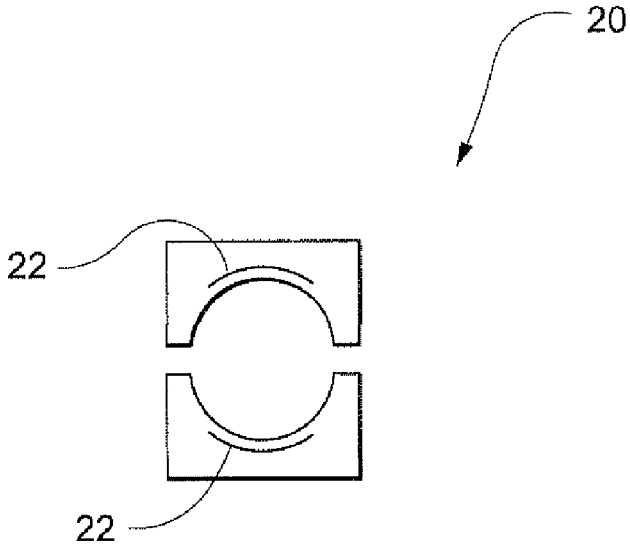
FIG. 2 is an end view of an exemplary mold for manufacturing the crayon of FIG. 1.

In manufacturing the crayons, first and second crayon halves are first secured in a cylindrical mold. An end view of an exemplary cylindrical mold 20 is shown in FIG. 2. Typically, the first crayon half is of a first color, and the second crayon half is of a second color different from the first color. The first and second crayon halves are set in the mold 20 with the flat ends 16, 18 facing each other and such that the halves are coaxially supported. The facing flat ends 16, 18 are heated via a suitable heating mechanism 22 appropriately positioned in the mold 20. Once the facing ends have reached a predetermined temperature, the first and second crayon halves are fused together.

Of course, other techniques for fusing the crayon halves may be utilized, including those that do not require heat, and the invention is not necessarily meant to be limited to the described exemplary application. Moreover, it is preferred that the crayon halves be pre-formed prior to fusing so that a clear division exists between the first crayon half and the second crayon half, although the invention is similarly not necessarily meant to be limited to this preferred construction.

The two-nib crayon described herein makes learning exercises using a color activity more fun for students. The two colors and two points per crayon also provide for a larger color selection without requiring additional crayons.

Additionally, children develop hand coordination and fine motor skills by flipping the crayon. As children grow and develop, so should the use of their hands. Hand skills can be impaired if one does not develop proper in-hand manipulation skills. There are 3 definitive in-hand manipulation skills:

1.) Translation

2.) Shift

3.) Rotation

The crayons described herein are designed to naturally enhance the use (thus the development) of these three skills. The small nature of the crayon combined with the dual color and dual tip does the following:

1. Translation: The small crayon fits easily in a child's hand and allows the child to move the crayon from the palm to the finger tips (in a linear motion) and vice versa. Functionally, the development of this skill would help a child remove a penny from their pocket, move the penny from the inside of their hands to their fingertips to place in a gumball machine.

2. Shift: The dual points and dual color facilitate shift. Shift occurs when a child is able to refine the finger movements for proper positioning. It is the ability to maneuver their fingers in the proper position towards the tip of the crayon. Because the child is 'flipping' the crayon, the skill of 'shift' is constantly occurring (fingers are always traveling up or down the length of the crayon). Functionally, this skill allows a child to pick up a pencil quickly, travel their fingers towards the tip of the pencil, and position their fingers near the tip to be able to use the tool proficiently.

3. Rotation: The dual points and dual colors facilitate rotation. Rotation occurs when the child 'flips' the crayon. Of all in-hand manipulation skills, 'rotation' takes the longest to mature. Functionally, this skill allows a child to utilize objects (toys, craft items, scissors, etc.) properly in their environment.

The maturation of in-hand manipulation skills are a necessity for one to successful perform daily tasks. The tools provided a child (if properly designed) can naturally enhance the development and growth of these skills. The two-nib crayons were carefully designed to encourage the use assist in the development of in-hand manipulation skills.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of manufacturing a two-nib crayon, the method comprising:

securing a first crayon half in a cylindrical mold, the first crayon half being of a first color;

securing a second crayon half in the cylindrical mold and coaxial with the first crayon half, the second crayon half being of a second color, different from the first color; and heating facing ends of the first and second crayon halves and fusing the facing ends together.

2. A method according to claim 1, wherein each of the first and second crayon halves comprises a flat end and a nib end, and wherein the steps of securing the first and second crayon halves are practiced by securing the first and second crayon halves in the cylindrical mold with the flat ends facing each other.

3. A two-nib crayon manufactured according to the method of claim 1.

* * * * *